US005911564A

United States Patent [19]

Sawyer

[11] Patent Number: 5,911,564

[45] **Date of Patent: *Jun. 15, 1999**

[54] CONTROL SYSTEM FOR MULTIPLE ENGINES

[76] Inventor: James K. Sawyer, 10311 Sagecourt Dr., Houston, Tex. 77089

[ * ] Notice: This patent is subject to a terminal disclaimer.

[21] Appl. No.: 08/829,776

[22] Filed: Mar. 31, 1997

Related U.S. Application Data

[63] Continuation-in-part of application No. 08/149,229, Nov. 9, 1993, Pat. No. 5,464,331, and application No. 08/554,006, Nov. 6, 1995, Pat. No. 5,616,010.

[51] Int. Cl.[6] ..... F04B 35/00

[52] U.S. Cl. ..... 417/369; 417/399; 92/138

[58] Field of Search ..... 92/138; 417/369, 417/399, 521

[56] References Cited

U.S. PATENT DOCUMENTS

| | | | |
|---|---|---|---|
| 27,426 | 3/1860 | Brown | 417/404 |
| 138,622 | 5/1873 | Eickemeyer | 417/316 |
| 766,237 | 8/1904 | Frisbie | 417/404 |
| 2,674,401 | 4/1954 | Mallory | 417/364 |
| 3,208,439 | 9/1965 | Ulbing | 417/364 |
| 3,414,187 | 12/1968 | McMullin et al. | 417/364 |
| 3,986,796 | 10/1976 | Muiroux et al. | 417/364 |
| 4,115,037 | 9/1978 | Butler | 417/364 |
| 4,362,477 | 12/1982 | Patten | 417/364 |
| 4,369,021 | 1/1983 | Heintz | 417/364 |
| 4,415,313 | 11/1983 | Bouthers | 417/364 |
| 4,705,460 | 11/1987 | Brain | 417/364 |
| 4,776,166 | 10/1988 | Dixon | 417/364 |
| 4,841,921 | 6/1989 | Yang | 417/364 |
| 4,992,031 | 2/1991 | Sampo | 417/364 |

*Primary Examiner*—Timothy S. Thorpe
*Assistant Examiner*—Ehud Gartenberg
*Attorney, Agent, or Firm*—Gunn & Associates, P.C.

[57] ABSTRACT

The present disclosure is directed to a power plant, and especially two or more such power plants connected together. The power plant especially features a piston connected with a reciprocated but non-rotating piston rod which connects with a pump piston at the opposite end. Power is generated by the power piston and imparted through straight reciprocating motion to the pumped piston. Two or more of these power plants are operated together by connecting them together through a connective link so that operation of one times the operation of two or more units slaved to the first. Synchronized operation is obtained.

8 Claims, 2 Drawing Sheets

10
20
11
12
17
44
14
16
13
18
16
15
70
71
72

CONTROL SYSTEM FOR MULTIPLE ENGINES

BACKGROUND OF THE DISCLOSURE

The present disclosure is a continuation-in-part from the disclosure which is set forth in U.S. Pat. No. 5,464,331 of Nov. 9, 1993 and also Ser. No. 08/554,006, filed on Nov. 6, 1995, now U.S. Pat. No. 5,616,010.

In that patent, a powered reciprocating piston connected with the piston rod is set forth. One special note in that disclosure is an arrangement in which the piston rod is reciprocated but the piston does not rotate. Specifically, the rod is reciprocated in linear or axial movement so that rotation is not needed. The present disclosure sets forth features by which such piston powered engines can be connected together to operate as a larger power plant. The device of the identified patent can be built so that scaling up to larger sizes provides for a larger power plant. While this can be done with few technical limits on increased size, there is the practical limit that larger sizes may provide the necessary power with sharp power surges. One of the advantages of a smaller version provided with two, three, or four identical piston and cylinder arrangements is that smoother operation can then be obtained. For smoother operation, multiple units are operated together. The present disclosure sets forth certain aspects of the single or multiple power piston engines. As an example, the engine can have one, two, three, or four power pistons connected to the same number of reciprocating piston rods, and thereby operate a similar number of compression cylinders on the rod(s).

In assembling two or more of the powered pistons in conjunction with the dedicated, straight, non-rotating piston rods, advantages of scale are achieved with the benefit of a smoother flow with smaller pulsations in a pumping system. As shown in the parent disclosure, a power piston is arranged at one end of a piston rod. A pump cylinder and piston is arranged at the opposite end and represents the load which is placed on the power piston. The pump end provides an output flow which has pressure peaks in it timed with the stroke of the power piston applied to the piston rod. These pulsations in pressure can be smoothed by using a downstream pressure accumulator. By omitting the pressure accumulator, smoothing can also be obtained through the use of two, three, or four pump pistons connected to a common manifold so that the common manifold is able to smooth the many surges. In smoothing the surges, a different and better mode of operation is obtained.

In one aspect of the present disclosure, two cooperative power plants which could otherwise run completely independently of the operation of the other are arranged so that they run together and system control is then obtained. The system control enables the multiple duplicate units to operate together or jointly. When joint operation is achieved, there are certain economies that result from the joint operation and the economies include a reduction in the number of duplicated components. The number of lubrication oil pumps which are used in the system can be reduced. Moreover, the several power plants which would otherwise be independent are harnessed together so that they operate in synchronized relationship. While the specifics of the synchronization can vary, it is important to assure that four such power plants (to pick a specific example) operate together so they are subject to a since control and therefore provide load adaptability as a single unit. While there are advantages to one unit, even more advantages can be obtained by yoking four otherwise independent power plants together so that they operate in unison.

The present disclosure also sets forth a system in which piston operation is timed with respect to a reference event, and the reference is typically operation of a duplicate set of equipment. Using the example of four such units, they can be timed so that the four units provide the requisite power for any load that might be imposed on the system.

SUMMARY OF THE INVENTION

Going now to the system of the present disclosure, it is summarized as one to several power plants in accordance of the teachings of U.S. Pat. No. 5,616,010 which, rather than operate independently, are joined together for cooperative operation so that two or more such units run together. They are synchronized in their operation with respect to each other. Moreover, the complexity is reduced by the omission of such auxiliary but essential equipment, i.e., electric alternators, lubrication oil pumps and the like. Only one unit provides adequate lubricating oil flow for all units. One feature is the provision of a unitary sleeve with integral left and right crank arms operating in unison.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
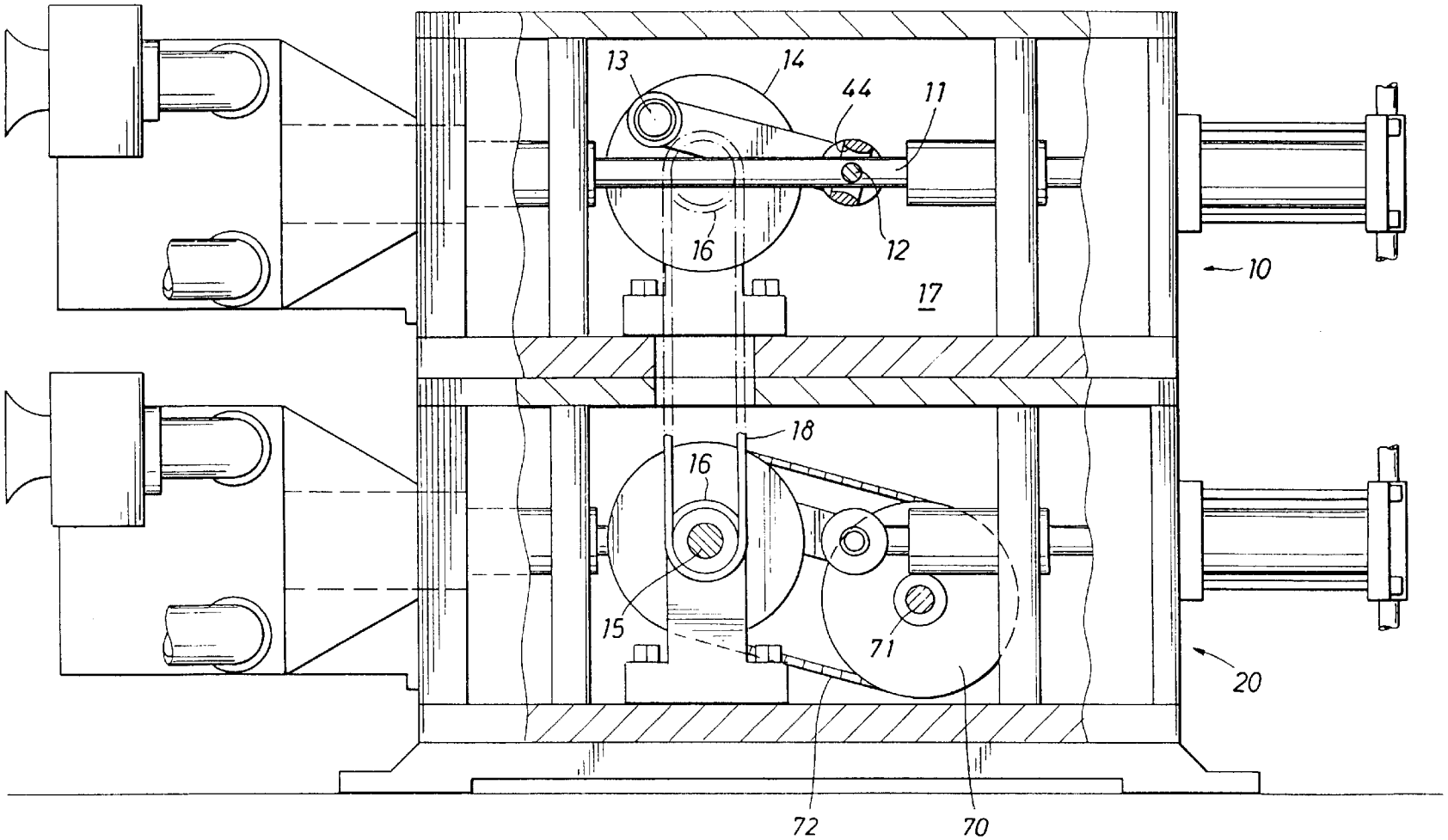
FIG. 1 is a sectional view through two power plants having a straight rod connected between a power piston and a pump piston and wherein two separate power plants are operated together by synchronization thereof through a connective link connecting the two power plants.

Attention is now directed to FIG. 1 of the drawings which illustrates two separate engines which have been joined together. To define the terms in a useful fashion, the numeral 10 identifies one engine in accordance with the teachings of the above-referenced issued patent. That device is made complete and operative and will be described as an engine or power plant. That is, it is a device which features the power piston, the pump piston, and the straight rod which connects between the two. In like fashion, the numeral 20 identifies a second and similar power plant. The two power plants are preferably identical in size and construction. However, it is not mandatory that they be equal in size. Indeed, they can have different sizes and can be scaled with different capacities in the power pistons to pick an example. For instance, the power piston in the engine 10 can have twice the displacement by increasing the diameter of the piston. Likewise, the piston in the pump 20 can be smaller, equal, or larger. What is important to note is that the two engines 10 and 20 are substantially similar. For the sake of convenience, they are shown to be equal in size and have equal strokes because common dimensions have been applied to both units. This is typically a manufacturing convenience to reduce cost, and it is also typically a manufacturing convenience to enhance the connection of the two so that they are operated with common strokes and movements.

The two engines are connected together so that they operate together. Power is generated by reciprocating motion so that the two are able to operate in synchronized fashion.

Going now to FIG. 1 of the drawings and focusing solely on the engine 10, the rod 11 is reciprocated in an axial movement two and fro or to the right and left as shown in the drawings. It is intercepted by a transverse pin 12 which is joined to it. The pin 12 extends to an eccentrically mounted shaft 13. The shaft is rotated, and thereby rotates a small wheel 14. All of the equipment described to this juncture typically is involved in a power take off mechanism for rotation of an alternator, a fuel pump, timing chain, or a lubrication fuel pump. Such devices are powered by connecting the flywheel 14 to rotate a shaft 15 (the reference numeral is applied to the engine 20 because clarity of drawing obscures the shaft 15 in the embodiment 10) and that rotates the connected equipment.

The shaft 15 is incorporated for operation of such auxiliary equipment. The equipment is deemed to be auxiliary in the sense that it does not create power but it provides needed services for the engine 10. In this particular instance, advantage is taken of the shaft 15 by mounting on the shaft 15 a sprocket 16 which is shown in dotted line in FIG. 1. A sprocket is ideally keyed to the shaft to rotate with the shaft. The shaft additionally connects with lubrication oil pumps and the like. For purposes of this disclosure, the shaft is normally located within the lubricated chamber 17, but is can also be mounted on the exterior of the chamber 17. At either location, the shaft is rotated at a rate of speed which is tied to or dependent on the rate of reciprocation of the rod 11. The shaft 15 is thus rotated and imparts power to the accessory equipment (defined as fuel pump, lubrication oil pump, electrical alternator, and other accessories for the engine). The flexible drive belt or chain 18 extends to engage a similar sprocket 16 located on the lower engine 20. As noted above, the sprockets 16 and the drive belt or chain 18 are vertically aligned. Conveniently they can be located on the exterior of the lubrication chamber 17 or can extend down through the lubrication chamber 17. In the latter event, this would define a single unitized lubrication chamber extending between both engines. In that event, it would be desirable to have specific lubricating oil outlets located so that all the moving parts are appropriately lubricated. More desirably, the engines 10 and 20 are illustrated so that the drive belt or chain 18 connects vertically from engine to engine thereby providing synchronized operation of the two engines 10 and 20.

Figure 2:
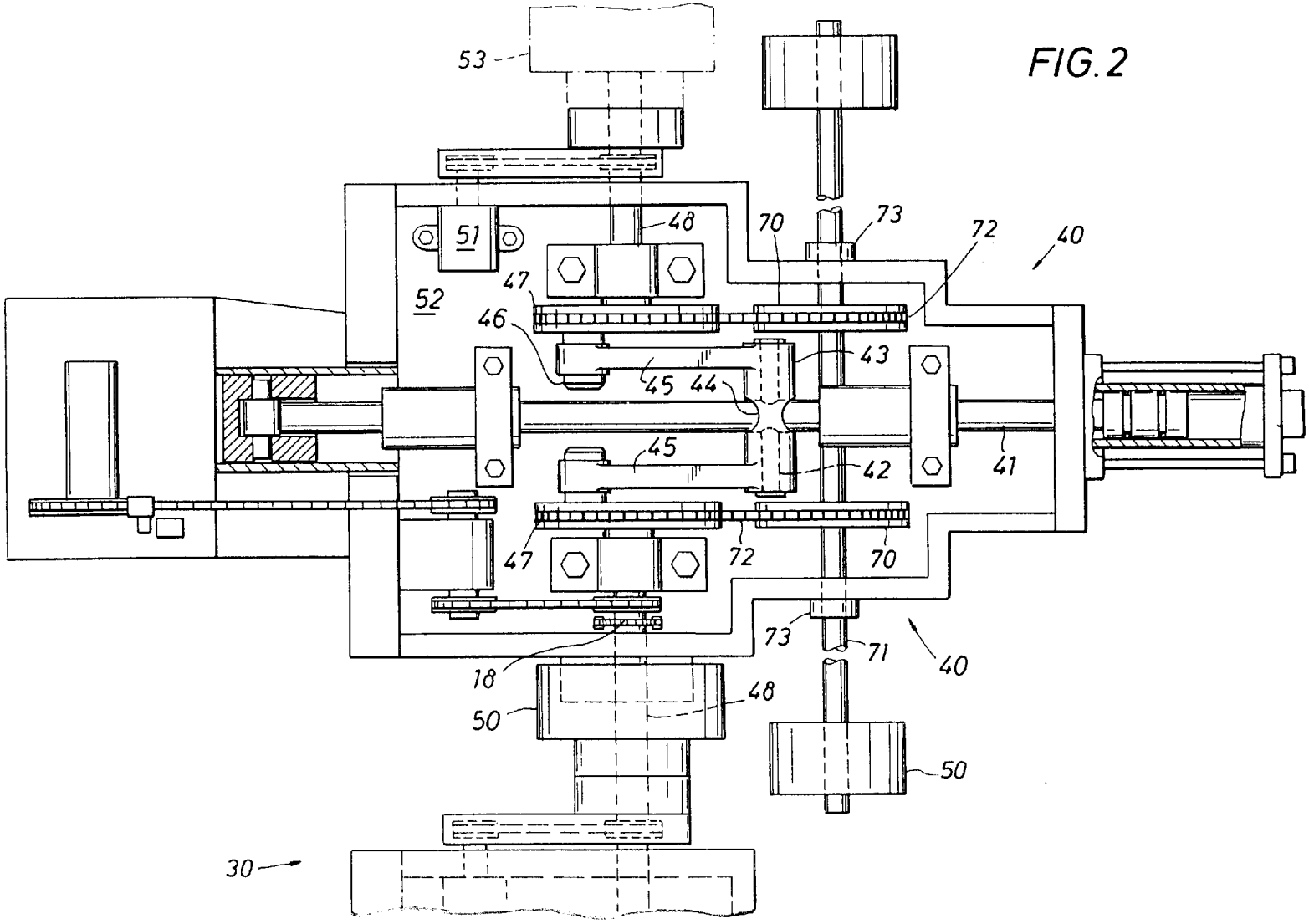
FIG. 2 is a plan view of one power plant showing a straight rod connected between opposing power piston and pump piston and further illustrating alternate connective links to enable comparable power plants to be operated in synchronization with the illustrated power plant.

Attention is now directed to FIG. 2 of the drawings which shows two engines 30 and 40 arranged in a side-by-side relationship. They are similar or identical, even identical in size and scale. Again, they can have different capacities, for instance by utilizing larger diameter pistons. FIG. 2 is an enhancement of the disclosure shown in FIG. 1 in the sense that the connective link, including the flexible belt or link chain is shown internally of the lubrication chamber. In particular, the engine 40 incorporates the flexible belt 18 to show an inside location for it; as previously mentioned it can be placed on the exterior, i.e., outside the oil lubrication chamber 17.

Going now to specifics of the structure shown in FIG. 2, a non-rotating reciprocating rod 41 moves left and right in FIG. 2 of the drawings. It is joined by a suitable transverse pin 42 which is located centrally of a larger transverse wrist pin 43. The wrist pin 43 is larger and is constructed with a transverse passage through it, the passage being enlarged as better shown in FIG. 1 of the drawings where the numeral 44 identifies a portion cutaway to permit the wrist pin 43 to wobble. The oval opening 44 defines an oval opening at both ends of the transverse passage in the sleeve positioned around the pin 43. The sleeve is permitted to oscillate (in rotation) around the pin 43. In this aspect and using both FIGS. 1 and 2, it will be observed that the wrist pin 43 is joined to an eccentric connected arm 45 at one or both ends, and oscillates through a limited angle. The angle of deflection of the eccentric arms 45 is an angle determined by the geometry of the diameter of the flywheel 14 shown in FIG. 1 and the length of the lever or arm 45 shown in FIG. 2. Suffice it to say, the eccentric arm is connected to an eccentric rod 46 and rotates the flywheel 47. The flywheel 47 connects with the shaft 48 shown in FIG. 2 of the drawings. As in the parent disclosure, the flywheel is preferably duplicated left and right and the shaft 48 is likewise duplicated. The two spaced eccentric arms 45 and the sleeve comprise a unitary structure so that the reciprocating rod motion becomes rotation imparted to the flywheels and ultimately to connected shaft mounted components. This enables two separate shafts to be aligned to connect to inboard or outboard accessories. Again, accessories include such things as fuel pumps, lubricated oil pumps, starter motors, electric alternators and the like.

Continuing with FIG. 2 of the drawings an electric alternator is included on the exterior by mounting an alternator 50 on the shaft 48. This can provide electrical power for operation. As desired, a lubricating oil pump 51 can be located in the chamber 52. It is powered from the shaft 48. A starter motor 53 can be connected to the equipment if desired. The example can be extended to other auxiliary apparatus. Of importance to the present disclosure, the engine 40 is complete and self-contained and is now illustrated connected to the engine 30 by the common shaft 48. Since the shaft 48 connects between both engines 30 and 40, they operate at the same speed and are synchronized to run together. Utilizing a shaft of this type, the two engines 30 and 40 can have a synchronized power stroke, or the shaft 48 can be connected so that the engines 30 and 40 run with a fixed phase shift in operation. The fixed phase shift is therefore the desired 180° phase difference in operation. When one is providing a pump intake stroke, the other is providing a pump delivery stroke. Further, it three or four engines are connected together, they can be phase shifted and operated by some alternate fixed angle, one example being 90° phase shift using four pumps of similar construction. Operation of the engines 10, 20, 30, and 40 shown in FIGS. 1 and 2 is substantially the same as previously described in the parent disclosure.

Control System For Multiple Engines

One feature of the present disclosure is the fact that several engines can be connected together to function as one power plant. Better than that, they can be operated individually so that the wear is distributed evenly among the several engines. Consider a situation in which a particular power plant is sized so that four of the engines of the present disclosure are required. At times, only one will be needed, and at other times all four will be needed. To distribute the work load, the present disclosure contemplates connecting four of the engines of this disclosure so that they operate together. Timing on the left side flywheel driven by the left arm 45 is best achieved relative to the right arm by making the two arms 45 integral with the sleeve 43 so that both arms move together with the sleeve 43. They are all in a common plane.

Added Shaft and Flywheel

Going now to FIG. 1 of the drawings, the numeral 70 identifies an added flywheel, which rotates on a shaft 71, which is mounted in the lubricated area, which is the oil lubrication chamber 17. The flywheel 70 is provided with cogs or teeth to engage a flexible belt 72. As illustrated, the two rotating toothed gears are equal in diameter and, therefore, rotate at the same rate. The ratio can be modified, for instance, by converting into a 1:2 ratio or any other ratio that might be desired. The most common ratio is a 1:2 ratio in which the rotation of the flywheel 70 is synchronized to the rotation of the flywheel 14 shown in FIG. 1. The shaft 71 is located below the rod 11 which provides motion in the equipment. Going to FIG. 2 of the drawings, the shaft 71 is shown extending fully across the lubrication chamber 17. Moreover, it is supported at a bearing assembly 73 which is sealed in the wall of the chamber 17. Comparable bearing assemblies 73 are at both ends. The shaft 71, therefore, is bathed in the lubricant in the chamber and is able to lubricate the belt and gear as illustrated.

In FIG. 2 of the drawings, there are two chains 72 so that the shaft 71 is rotated by both of the arms 45. By this approach, the two arms 45 can be synchronized to move together. Even if they could pivot (and they cannot with respect to each other), they oscillate in unison because they are connected to rotate the flywheels described above, but, in addition, they rotate the added flywheels 70 in response to movement of the link belts or chains 72. In other words, the two arms 45 rotate together and they are assured of rotation together because they are tied together through the duplicate belts and duplicate flywheels illustrated in the equipment and mounted on the shaft 71. In this instance, it is preferable that both of the flywheels 70 be fixed by a set screw on the hub to the shaft 71.

Both of the flywheels 70 can have distributed weight so that they have no heavy spots. On the other hand, it is possible to incorporate a counterbalance weight in either or both. Dynamic balancing of the motor to reduce power surges can be achieved through counterbalance weights. In other words, the flywheels 70 can be uniform and have even weight distribution around the circle, or they can be made with a heavy counterbalance weight. The size of the weight and its specific location depends on the measure of vibration to be offset during operation.

FIG. 2 shows how the shaft 71 is readily available to mount powered equipment such as an alternator 50 on the end of the shaft. Alternately, a fuel pump or oil pump can be mounted at that location and powered at that location. Generally, the shaft 71 is used to support one or two flywheels which provide a smoothing action to operation, i.e., power surges are smoothed by the flywheel action.

While the foregoing is directed to the preferred embodiment, the scope is determined by the claims which follow.

I claim:

1. A power plant comprising:

(a) a power piston in a cylinder;

(b) a straight piston rod connected with said power piston;

(c) a pump piston in a cylinder serially connected to said rod;

(d) wherein said power piston provides power for said rod and said rod is moved in axial reciprocating motion to stroke said pump piston;

(e) a transversely deployed link connected to said rod so that motion of the rod is transferred and timed with respect to motion of said rod, said link comprising:

(i) a pin at a right angle to said rod;

(ii) first and second pin-supported parallel arms at the end of said pin;

(iii) first and second pin-connected rotatable flywheels eccentrically connected to said first and second arms for rotation thereby; and (iv) a sleeve around said pin fixedly connected to said parallel arms having an oval opening in said sleeve to permit said sleeve to rotate about said pin with said rod positioned in said oval opening.

2. The apparatus of claim 1 wherein said pin supports said arms at identical angles with respect to said rod.

3. The apparatus of claim 1 wherein said arms are a unitary structure with said sleeve.

4. The apparatus of claim 3 wherein said unitary structure comprises an elongate sleeve having a pin receiving passage therein and at a right angle to said oval opening.

5. The apparatus of claim 4 wherein each of said arms has a distal end connecting to said flywheels.

6. A first power plant connected to a second power plant wherein said first power plant comprises:

(a) a power piston in a cylinder;

(b) a straight piston rod connected with said piston;

(c) a pump piston in a cylinder serially connected to said rod;

(d) wherein said power piston provides power for said rod and said rod is moved in axial reciprocating motion to operate said piston pump; and (e) a timed movement-transfer apparatus connected from said rod of the first power plant so that said second power plant is timed to operate in synchronized relationship, wherein said timed transfer apparatus comprises:

(i) a first sprocket in said first power plant;

(ii) a flexible drive belt extending from said first sprocket to impart transferred and timed movement;

(iii) a motion transfer mechanism connected to said piston rod to be rotated thereby with rod reciprocation and impart rotation to said first sprocket so that said belt drive movement is transferred; and (iv) a second sprocket engaged with and driven by said flexible belt drive to transfer timed movement wherein said second sprocket is in said second power plant and times operation thereof.

7. The apparatus of claim 6 wherein said second sprocket is connected to a piston rod in said second power plant through the sprocket shaft and a flywheel mounted on said shaft so that rotation of said second sprocket imparts timed reciprocation to the piston rod of said second power plant.

8. The apparatus of claim 7 wherein said piston rod of said first power plant is connected by said motion transfer mechanism to said first sprocket through a reciprocated eccentric arm converting reciprocating motion of said rod into rotational motion imparted to a rotating shaft supporting said first sprocket.

* * * * *